US007168972B1

(12) United States Patent
Autry et al.

(10) Patent No.: US 7,168,972 B1
(45) Date of Patent: Jan. 30, 2007

(54) COMPUTER INTERFACE JACK

(75) Inventors: Sidney David Autry, Liberty Lake, WA (US); David Stockham, Deer Park, WA (US); Jeff Anderson, Spokane Valley, WA (US)

(73) Assignee: Itronix Corporation, Spokane, WA (US)

( * ) Notice: Subject to any disclaimer, the term of this patent is extended or adjusted under 35 U.S.C. 154(b) by 0 days.

(21) Appl. No.: 11/410,887

(22) Filed: Apr. 26, 2006

(51) Int. Cl.
*H01R 4/50* (2006.01)

(52) U.S. Cl. ..... 439/344; 439/354; 439/923

(58) Field of Classification Search ..... 439/344, 439/354, 352, 923
See application file for complete search history.

(56) References Cited

U.S. PATENT DOCUMENTS 5,591,042 A * 1/1997 Takata et al. ..... 439/354
2006/0148301 A1* 7/2006 Kim ..... 439/354

* cited by examiner

*Primary Examiner*—Tho D. Ta
(74) *Attorney, Agent, or Firm*—Hunton and Williams LLP

(57) ABSTRACT

A female electrical connector is provided for receiving a standardized male electrical connector having a movable release tab. The female electrical connector includes an electrical connector body, at least one electrical contact, and at least one lock member. The electrical connector body has an axial cavity configured to receive a male connector. The at least one electrical contact is provided in the cavity. The at least one lock member is carried by the body in load deflecting relation relative to an opposed inner face of the cavity. The at least one lock member is configured to displace relative to the inner face between a loaded position and a released position responsive to a release tab of a male electrical connector applying an overload condition on the at least one tab.

23 Claims, 5 Drawing Sheets

COMPUTER INTERFACE JACK

FIELD OF THE INVENTION

This invention pertains to cable interconnection devices. More particularly, the present invention relates to cable connectors, such as jacks, and connector assemblies having load release features between the connector jack and the connector plug.

BACKGROUND OF THE INVENTION

Computer networking and telephone connectivity have utilized a terminating connector assembly design designated as RJ45 and RJ11 respectively. "RJ" standard for Registered Jack illustrated by RJ11 and RJ45 plugs and jacks. RJXX is a general term for multiple electrical connector designs used for telephone and data, including the RJ11, RJ14, RJ25, RJ48, RJ61 and RJ45 connectors. The numbering and pinouts were set forth by the Bell System as the Universal Service Order Code (or Universal Service Ordering Code) (USOC). They are also registered with the U.S. Federal Communications Commission (FCC), under 47 C.F.R. § 68.502. Though these RJXX connectors vary in the number of pins or electrical connections per connectors, they are all characterized as generally rectangular assemblies having a given number of parallel connectors. The male connector has a positive latch provided between the associated plug and jack that will not release under load. This latch serves to "lock" the male connector into the female socket of the connector assembly, thereby preventing unintended disconnection. In some applications, the female connectors are installed into a housing of an electrical device such that they are recessed relative to an outer surface of the device. As a result, a release tab on the male connector, or plug is also recessed which makes it difficult to release the male connector from a complementary female connector, or jack. In such cases, users can become frustrated when trying to disconnect the plug from the jack, thereby applying excessive force by pulling the cable on which the plug is provided until the plug separates from the jack without disconnecting the positive latch provided between the plug and the jack. This typically results in failure of the locking tabs of the plug or the jack, and the connector assembly no longer retains the plug in the jack. While in home telephone or desktop computing applications, connector breakage may be primarily due to frustration over the inability to disconnect, in mobile computer applications such as ruggedized or wearable computing application connector breakage may be caused by excess tension on the cable experienced through ordinary usage.

FIGS. 1–3 illustrate a prior art construction for an electrical connector assembly 10 comprising an RJ45 male electrical connector, or plug 12 and a complementary RJ45 female electrical connector, or jack 14. Plug 12 includes a plug body 16 supporting a plurality of electrical contacts 32 (see FIG. 3) that each form an electrical contact in assembly with complementary electrical contacts 30 within an aperture, or cavity 18 of jack 14. Contacts 30 are spring mounted relative to wall 29 of cavity 18.

A pivoting support arm 20 on plug 12 is spaced from body 16 prior to mating within a jack, as shown in FIG. 2. Arm 20 is urged toward body 16 upon insertion within cavity 18, as shown in FIG. 1. In such inserted condition, a pair of tabs 22 and 24 clear complementary tabs 26 and 28 of jack 14 to provide locked inter-engagement there between, as shown in FIGS. 1 and 3. To release plug 12 from jack 14, a user urges arm 20 toward body 16 such that the respective tabs 22 and 24 clear tabs 26 and 28 to facilitate removal of plug 12 from jack 14. However, a problem is encountered with some design applications where jack 14 is mounted within a housing of a portable electronic device, such as a laptop computer. If jack 14 is recessed within the housing, there might not be sufficient access for a user's fingers to engage and manipulate arm 20. Accordingly, frustrated users have been known to forcibly remove plugs 12 from such jacks 14 such that tabs 22, 24 and/or tabs 26, 28 break and the resulting connector assembly is no longer able to releasable lock together. Also, as noted above, breakages have occurred due to stress on the cables in mobile application where a communications cable may be overextended due to being moved while still tethered. Hence, improvements are needed in order to overcome such deficiencies.

SUMMARY OF THE INVENTION

In view of the above-noted deficiencies of known connector types, various embodiments of the invention may provide an RJXX connector that utilizes a locking connector that disengages when a sufficient amount of tension is applied to separate the male connector from the female socket without breaking either the socket or arm.

According to at least one embodiment of the invention, a female electrical connector is provided for receiving a standardized male electrical connector having a movable release tab. The female electrical connector according to this embodiment may include an electrical connector body, at least one electrical contact, and at least one lock member. The electrical connector body may also have an axial cavity configured to receive a male connector with at least one electrical contact is provided in the cavity. The at least one lock member may be carried by the body in load deflecting relation relative to an opposed inner face of the cavity. The at least one lock member may be configured to displace relative to the inner face between a loaded position and a released position responsive to a release tab of a male electrical connector applying an overload condition on the at least one tab.

According to at least one other embodiment, a female electrical connector is provided of a type for mating/demating with a male electrical connector having a movable release tab. The female electrical connector according to this embodiment may include a connector receiver, at least one electrical contact, and at least one lock member. The connector receiver may also have a cavity encompassed by at least one wall and is configured to receive the male connector with the at least one electrical contact provided in the cavity. The at least one lock member may be carried in flexible relation by the body opposite one of the at least one wall to urge apart from the wall in response to an overload being applied to the at least one lock member during attempted removal of the male member from the female member.

According to yet another aspect, an electrical connector assembly is provided for receiving standardized male electrical connectors having a movable release tab. The electrical connector assembly according to this embodiment may include a first electrical connector body, a second electrical connector body, at least one electrical contact, and at least one lock member. The first electrical connector may have an axial cavity configured to receive a first male connector. The second electrical connector body may have an axial cavity configured to receive a second male connector. The at least one electrical contact may be provided in each of the first cavity and the second cavity. The at least one lock member may be carried by each of the first electrical connector body and the second electrical connector body in load deflecting relation relative to an opposed inner face of the cavity. The at least one lock member may be configured to displace relative to the inner face between a loaded position and a released position responsive to a release tab of a respective male electrical connector applying an overload condition on the at least one tab.

Still a further embodiment according to the invention may provide a female RJXX connector. The female RJXX connector according to this embodiment may comprise a connector cavity having an axis running from a cavity opening to a back wall and adapted to receive at least one standard RJXX male connector axially inserted therein, and a tensioned lock mechanism associated with the connector cavity, adapted to mate with a locking support am of the at least one standard RJXX male connector, wherein the tensioned lock mechanism is adapted to release the locking support arm the at least one male connector when a threshold level of force is applied to the at least one male connector in a substantially axial direction away from the connector cavity.

These and other embodiments and advantages of the present invention will become apparent from the following detailed description, taken in conjunction with the accompanying drawings, illustrating by way of example the principles of the invention

BRIEF DESCRIPTION OF THE DRAWINGS

Preferred embodiments of the invention are described below with reference to the following accompanying drawings.

DETAILED DESCRIPTION

The following description is intended to convey a thorough understanding of the embodiments described by providing a number of specific embodiments and details involving a break away RJXX type electrical connector. It should be appreciated, however, that the present invention is not limited to these specific embodiments and details, which are exemplary only. It is further understood that one possessing ordinary skill in the art, in light of known systems, methods and apparatus', would appreciate the use of the invention for its intended purposes and benefits in any number of alternative embodiments, depending upon specific design and other needs.

Reference will now be made to a preferred embodiment of Applicant's invention comprising a female electrical connector jack assembly 100. While the invention is described by way of a preferred embodiment, it is understood that the description is not intended to limit the invention to such embodiment, but is intended to cover alternatives, equivalents, and modifications which may be broader than the embodiment, but which are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 4:
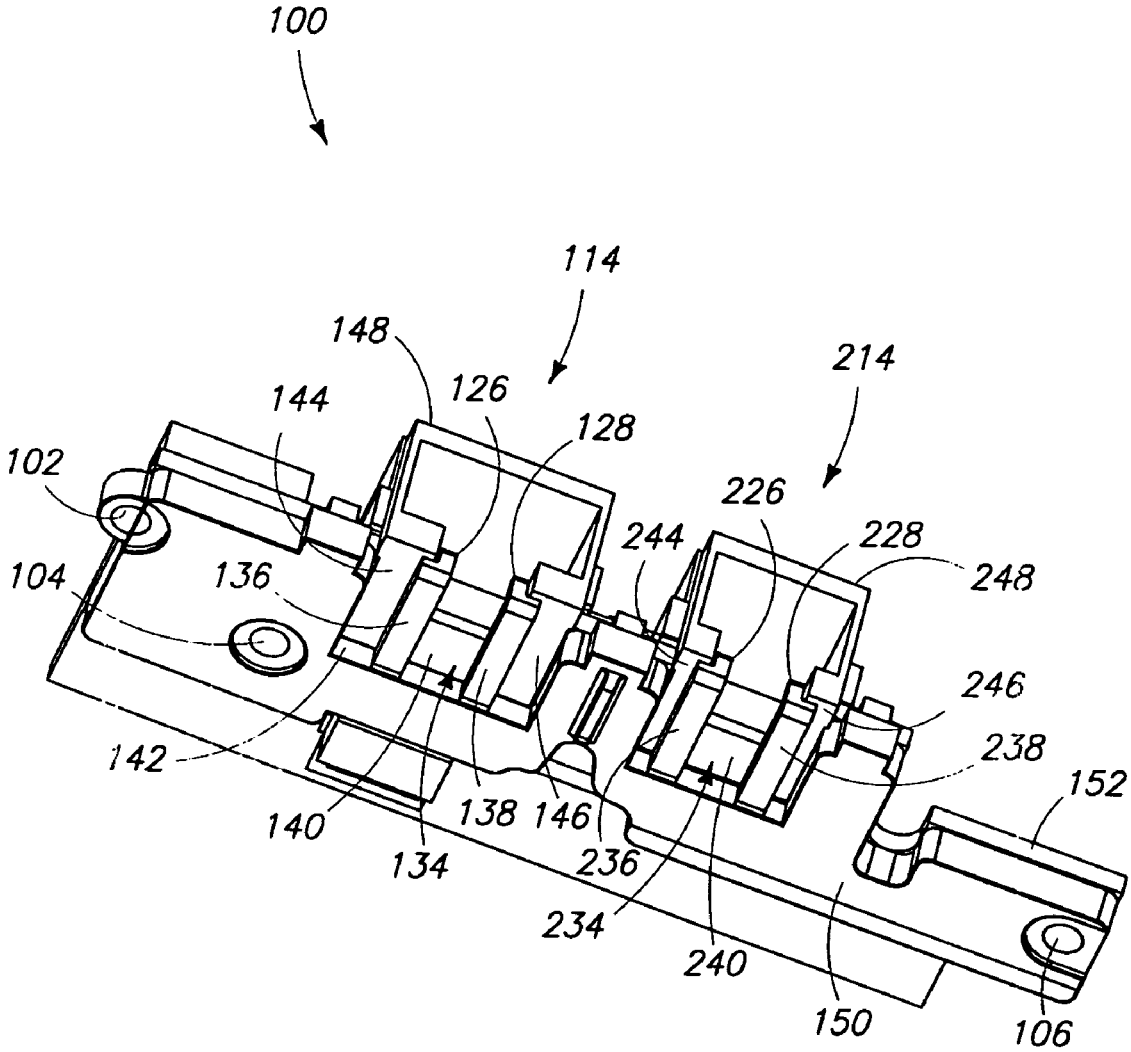
FIG. 4 is a component perspective view of an exemplary female electrical connector jack assembly for a laptop computer having RJ11 and RJ45 jacks according to at least one embodiment of the present invention.

Referring now to FIG. 4, a jack assembly 100 having a body 150 with a plurality of apertures 102, 104 and 106 configured to receive fasteners (not shown) for mounting the jack assembly 100 onto a printed circuit board within a laptop computer, or other portable electronic device is illustrated. Alternatively, the jack assembly 100 can be mounted onto a housing or frame of a device such as a computing device, or wall jack, etc. A pair of jacks 114 and 214 is formed from a body 152 that is affixed onto body 150 such that jacks 114 and 214 are aligned with access ports on the laptop computer to provide access to jacks 114 and 214 for receiving complementary plugs. According to one construction, bodies 150 and 152 may be formed from plastic or other suitable non-conducting material. It should be appreciated that in addition to mounting the jack assembly on a printed circuit board within a laptop computer, it may be mounted onto a wall jack frame, such as in a household or office environment, a modem and/or NIC card, a bus, router, hub, etc., or onto another suitable mounting structure.

In at least one exemplary embodiment, each jack 114 and 214 may include a lock assembly 134 and 234, respectively, that is integrally formed from body 150. More particularly, each arm 136, 138 and 236, 238 and bridge wall 140, 240 may be integrally formed from the body 150. Arms 136, 138 and 236, 238 may each be formed separately from a wall member 144, 146 and 244, 246 of a respective body 148 and 248 for each jack 114 and 214, respectively. In this manner, each arm is configured to flex outwardly away from each wall member in response to a plug being forcibly pulled from within the respective jack.

It should be appreciated that in various other embodiments, a different lock assembly may be formed that utilizes resistance to hold the male jack arm in place, thereby securing the male-female assembly in a manner that will release the male connector when a threshold level of tension is applied away from the female socket. For example, rather than pair of arms, a single bifurcated arm may be used, one or more leaf springs. Alternatively, the face of the female connector socket may be biased to engage the tag of a standard male connector tab. Any suitable locking mechanism may be utilized with the various embodiments of the invention so long as the mechanism releases the male connector against a threshold level of force prior to failure of the male connector's release tab.

Figure 1:
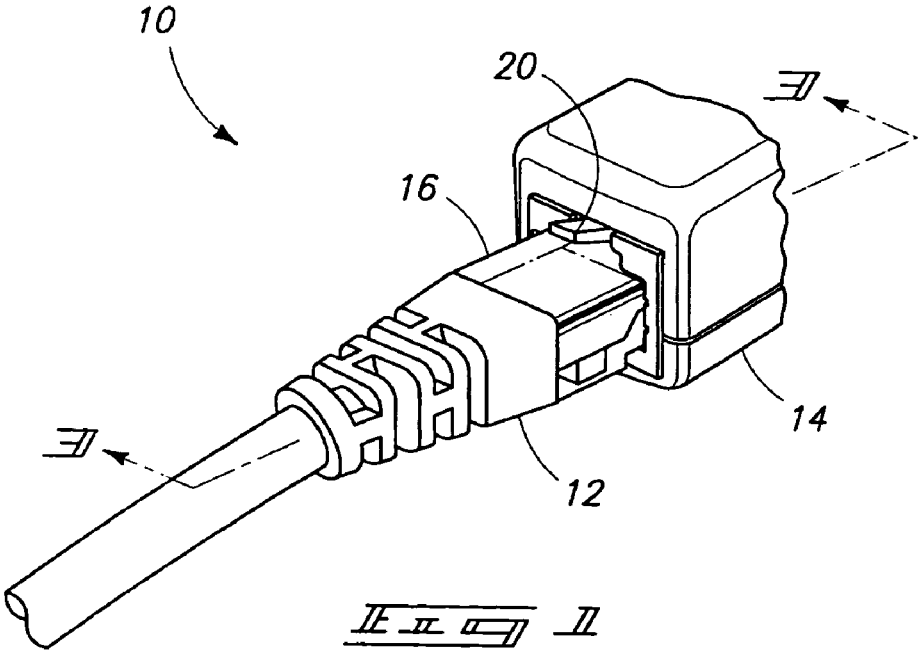
Fig 1 PRIOR ART
FIG. 1 is an enlarged partial perspective view of an electrical connector assembly having an RJ45 plug and an RJ45 jack shown connected together in a loaded and locked condition.
Figure 2:
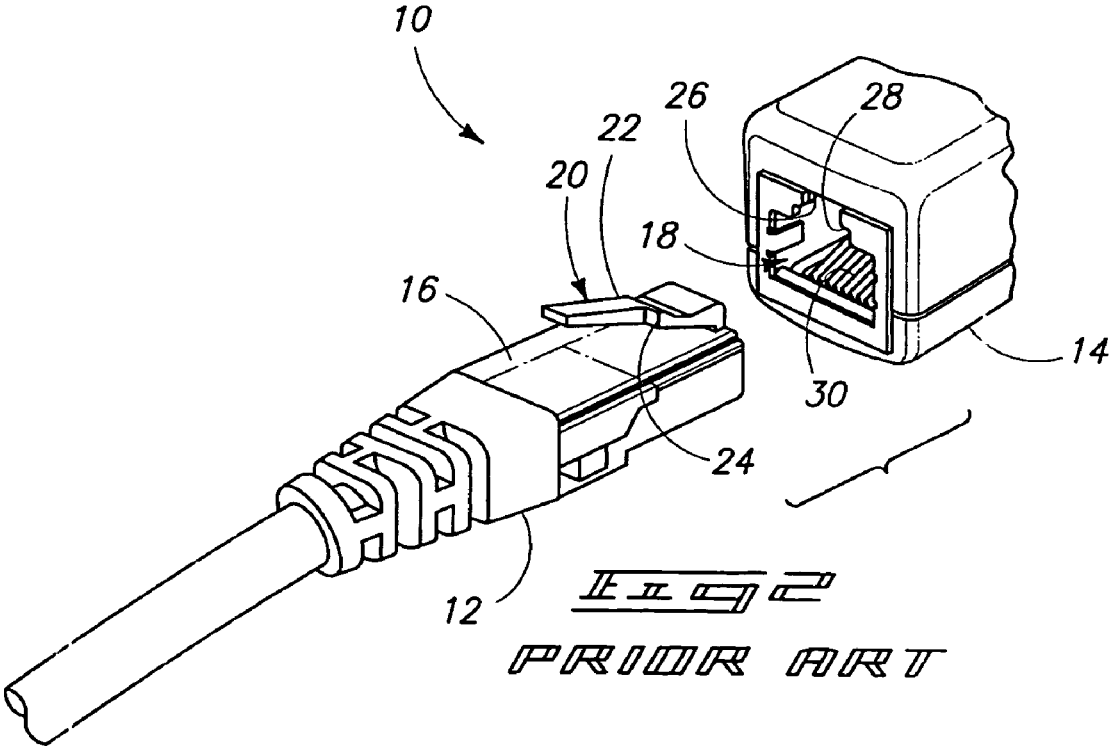
Fig 2 PRIOR ART
FIG. 2 is an enlarged partial perspective view of the electrical connector assembly of FIG. 1 showing the RJ45 plug and jack shown prior to being connected together.
Figure 3:
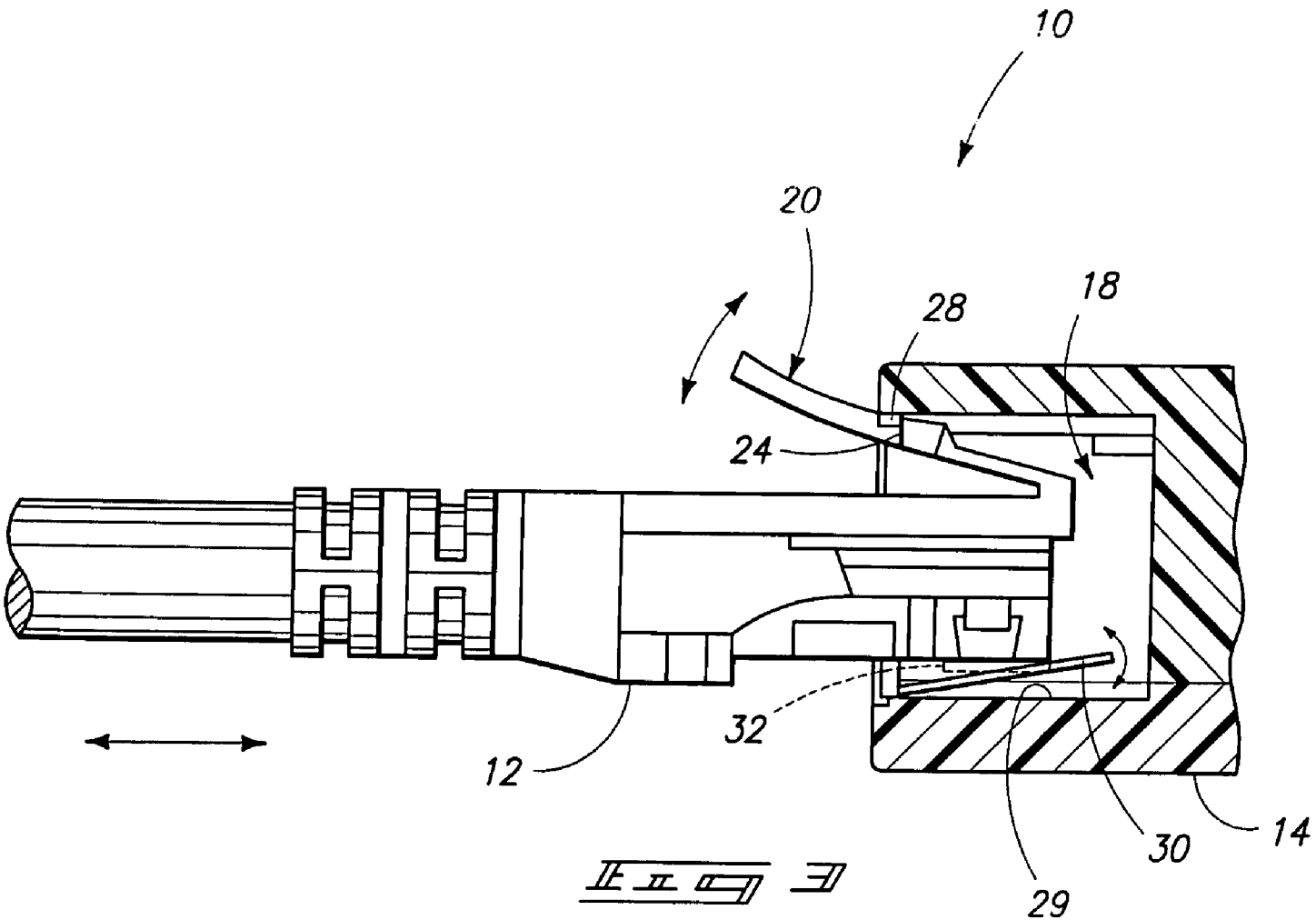
FIG 3 PRIOR ART
FIG. 3 is a sectional view taken along line 3—3 of FIG. 1 illustrating the loaded and locked condition of the plug and jack.

As shown in the exemplary embodiment illustrated in FIG. 4, each arm 136, 138 and 236, 238 terminates in an integrally formed finger 126, 128 and 226, 228 that extends laterally of the respective arm. Each finger 126, 128 and 226, 228 may provide a tab that interdigitates with a respective tab on a complementary male connector, in this case corresponding RJ45 and RJ11 plugs. Under normal operating conditions, fingers 126, 128 and 226, 228 are released from the respective tabs on a corresponding RJ45 and RJ 11 plug by squeezing together a pivoting support arm (such as arm 20 of FIGS. 1–3) toward a body of the plug. However, for cases where the arm is difficult to access, a user might just forcibly pull out the plug from the jack. In such case, arms 136, 138 and 236, 238 and fingers 126, 128 and 226, 228 (along with arms 136, 138 and 236, 238) flex away from the opposed back walls 129 and 229 of jacks 114 and 214 (see FIG. 5), thereby allowing the tabs to disengage without breaking the jack or the plug. Accordingly, the connector assembly can still be reused an no damage to the male connector will be sustained.

Figure 5:
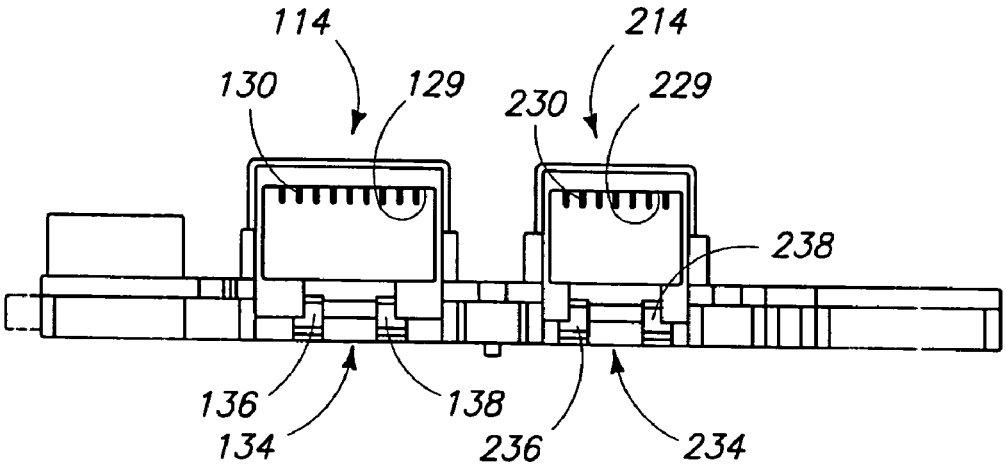
FIG. 5 is a plan view of the female electrical connector jack assembly of FIG. 4.
Figure 6:
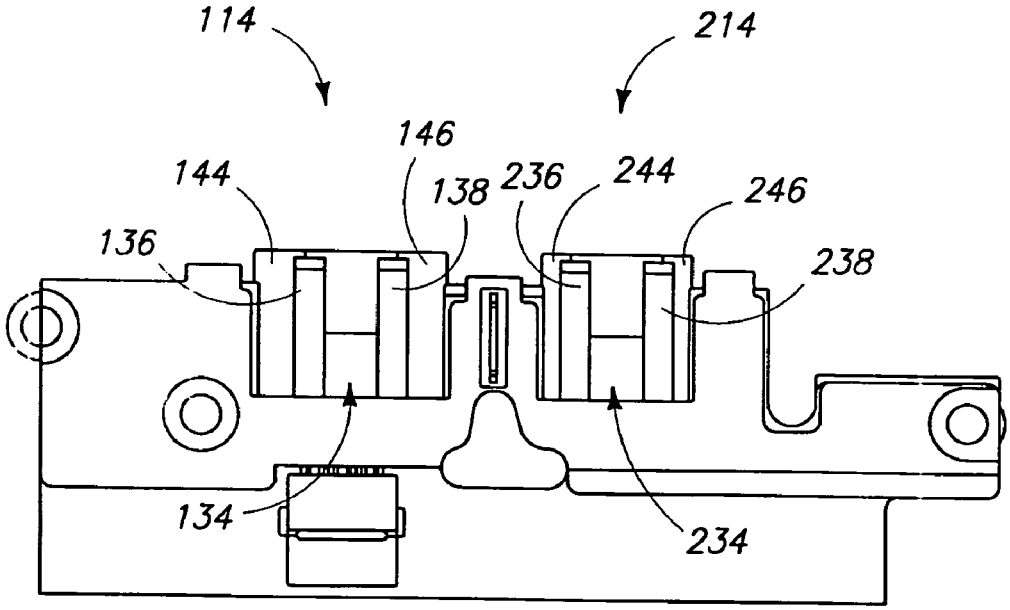
FIG. 6 is a front elevational view of the exemplary female electrical connector jack assembly of FIGS. 4–5.

FIGS. 4–6 illustrate arms 136, 138 and 236, 238 and fingers 126, 128 and 226, 228 of jacks 114 and 214, respectively, in an unloaded state, prior to inserting a complementary jack according to various exemplary embodiments. As shown in FIG. 6, arms 136, 138 and 236, 238 are integrally formed from base wall 142 of body 150 (see FIG. 4). However, arms 136, 138 and 236, 238 are separate from wall members 144, 146 and 244, 246 of bodies 148 and 248, respectively. Upon locked insertion into jacks 114 and 214, a respective plug forms a plurality of electrical connections with respective electrical contacts 130 and 230 within each jack 114 and 214.

Figure 7A:
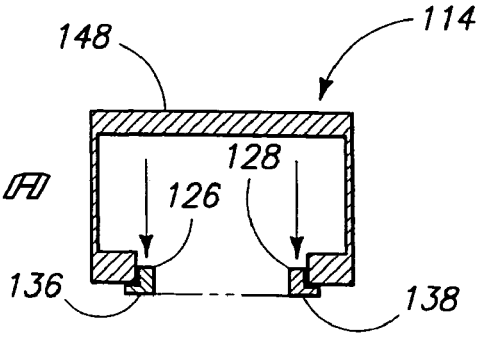
FIGS. 7A and B is a simplified sectional view of a selected one of the jacks on the exemplary assembly of FIGS. 4–6 when unloaded.
Figure 7B:
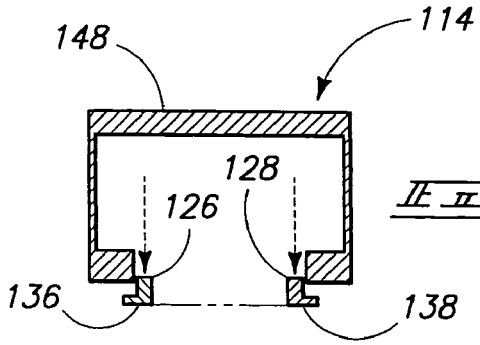

FIGS. 7A and 7B illustrate, in simplified form, the locked and unlocked positions of arms 136 and 138 relative to body 148 of jack 114. FIG. 7A shows the position of arms 136 and 138 when a plug has been received and locked into jack 114. FIG. 7B shows the position of arms 136 and 138 as a plug is being forcibly removed from jack 114, thereby causing arms 136 and 138 to flex under load away from wall 129 sufficiently so that the tabs on the arms and tabs on the jack decouple, enabling removal of the plug (e.g., plug 12 of FIGS. 1–3) from jack 114.

Figure 8A:
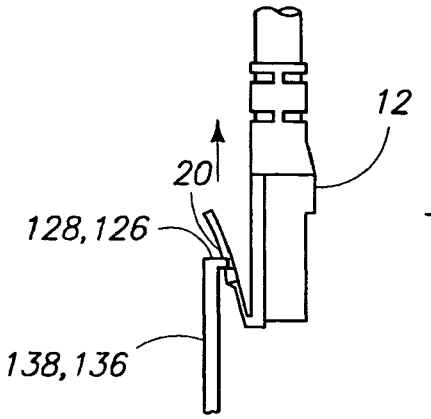
FIGS. 8A and B is a simplified sectional view of a selected one of the jacks on the exemplary assembly of FIGS. 4–6 when loaded.
Figure 8B:
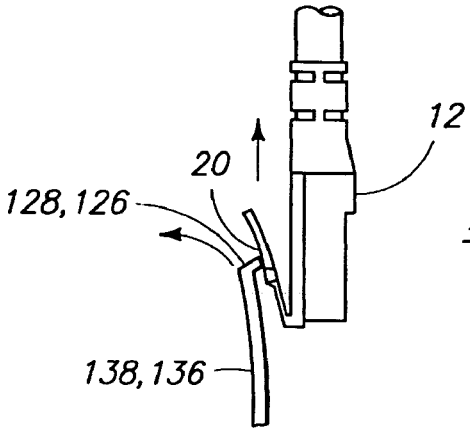

FIGS. 8A and 8B illustrate in simplified schematic form a side elevational view of an RJ45 plug being forcibly pulled from the arms 138, 136 and fingers 128, 126 of a complementary RJ45 jack. As shown in FIG. 8A, plug 12 is being forcibly pulled so that tabs on movable support arm 20 pull upwardly on the tabs formed by fingers 128 and 126, causing arms 138, 136 and fingers 128, 126 to flex and elastically deform into the position depicted in FIG. 8B, thereby enabling release of plug 12 from the jack on which arms 138, 136 are provided. After release of plug 12, arms 138, 136 and fingers 128, 126 return to their original shape and position, rendering the jack reusable for connecting with plug 12. Hence, damage to the jack is prevented.

It should be appreciated that while the female connector illustrated in FIGS. 4–8 employs a pair of spring loaded or tensioned arms to engage a release tab of a standard RFXX connector, that any type of known or previously unknown tension release mechanism may be utilized with the various embodiments without departing from the spirit or scope of the invention. Rather, the various embodiments, provide for a method a female connector that reduces and ideally prevents inadvertent destruction of the male connector release tab due to frustration over the inability to release or due to excess tension applied to the electronic cable terminating in the RJXX connector assembly.

The embodiments of the present inventions are not to be limited in scope by the specific embodiments described herein. For example, although many of the embodiments disclosed herein have been described with reference to a female RFXX connector and connector assembly for computer devices, the principles herein are equally applicable to other aspects of providing electrical connection. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

We claim:

1. A female electrical connector for receiving a standardized male electrical connector having a movable release tab, comprising:

a female electrical connector body having an axial cavity configured to receive the standardized male electrical connector;

at least one electrical contact provided in the axial cavity; and at least one lock member carried by the body in load deflecting relation relative to an opposed inner face of the axial cavity and configured to displace relative to the inner face between a loaded position and a released position responsive to a movable release tab of the standardized male electrical connector applying an overload condition on the movable release tab.

2. The female electrical connector of claim 1, wherein the at least one lock member is sprung from the connector body to provide lateral deflection away from the inner face responsive to the overload condition from the movable release tab of the standardized male electrical connector.

3. The female electrical connector of claim 1, wherein a pair of the lock members are carried by the body.

4. The female electrical connector of claim 1, wherein the axial cavity comprises a rectangular cavity.

5. The female electrical connector of claim 1, wherein the connector body is configured to mate with a male RJ11 electrical connector.

6. The female electrical connector of claim 1, wherein the connector body is configured to mate with a male RJ45 electrical connector.

7. The female electrical connector of claim 1, wherein the lock member comprises a pair of lock members each having an elongated arm terminating in a lateral finger.

8. The female electrical connector of claim 7, wherein each elongated arm and lateral finger comprises an elastic material capable of being urged in a lateral direction responsive to overloading of the finger by the standardized male electrical connector being forcibly removed from the female electrical connector.

9. The female electrical connector of claim 7, wherein the lock member further comprises a bridge wall extending between the pair of lock members and spaced from the respective fingers.

10. A female electrical connector of a type for mating/demating with a male electrical connector having a movable release tab, comprising:

a connector receiver with a cavity encompassed by at least one wall and configured to receive the male electrical connector;

at least one electrical contact provided in the cavity; and at least one lock member carried in flexible relation by the connector receiver opposite one of the at least one wall to urge apart from the wall in response to an overload being applied to the at least one lock member during attempted removal of the male electrical connector from the female electrical connector.

11. The female electrical connector of claim 10, wherein the connector receiver comprises a rectangular body supporting a plurality of the electrical contacts within the connector receiver.

12. The female electrical connector of claim 10, wherein a plurality of electrical contacts are provided within the connector receiver.

13. The female electrical connector of claim 10, wherein the at least one lock member comprises a pair of tabs each provided by a finger on a distal end of the respective lock member.

14. The female electrical connector of claim 10, wherein the at least one lock member is integrally formed from the connector receiver.

15. The female electrical connector of claim 10, wherein a pair of lock members is provided joined together by a bridge wall and depending from the connector receiver.

16. The female electrical connector of claim 15, wherein each lock member comprises an elongated arm terminating in a laterally extending finger, each finger providing a respective tab, and the finger and the tab are formed from elastic material capable of being deformed under load.

17. The female electrical connector of claim 10, wherein the at least one lock member comprises a flexible arm terminating in a flexible finger extending laterally of the arm.

18. The female electrical connector of claim 17, wherein the at least one lock member comprises a pair of the flexible arms each terminating in a respective one of the flexible fingers.

19. The female electrical connector of claim 17 wherein the connector receiver comprises a rectangular electrical connector body.

20. An electrical connector assembly for receiving standardized male electrical connectors having a movable release tab, comprising:

a first electrical connector body having a first axial cavity configured to receive a first male electrical connector;

a second electrical connector body having a second axial cavity configured to receive a second male electrical connector;

at least one electrical contact provided in each of the first axial cavity and the second axial cavity; and at least one lock member carried by the first electrical connector body in load deflecting relation relative to an opposed inner face of the first axial cavity and configured to displace relative to the inner face between a loaded position and a released position responsive to a movable release tab of the first male electrical connector applying an overload condition on the movable release tab;

at least one lock member carried by the second electrical connector body in load deflecting relation relative to an opposed inner face of the second axial cavity and configured to displace relative to the inner face between a loaded position and a released position responsive to a movable release tab of the second male electrical connector applying an overload condition on the movable release tab of the second male electrical connector.

21. The electrical connector assembly of claim 20, wherein the first electrical connector body is an RJ11 connector body and the second electrical connector body is an RJ45 body.

22. The electrical connector assembly of claim 20, wherein the at least one lock member comprises a pair of flexible arms each terminating in a laterally extending finger configured to engage and lock with respective tabs on a complementary electrical connector plug.

23. A female RJXX connector comprising:

a connector cavity having an axis running from a cavity opening to a back wall and adapted to receive at least one standard RJXX male connector axially inserted therein; and a tensioned lock mechanism associated with the connector cavity, adapted to securely engage a release tab of the at least one standard RJXX male connector, wherein the tensioned lock mechanism is adapted to release the release tab of the at least one standard RJXX male connector when a threshold level of force is applied to the at least one standard RJXX male connector in a substantially axial direction away from the connector cavity.

* * * * *